US006390929B2

(12) United States Patent
Hyatt

(10) Patent No.: US 6,390,929 B2
(45) Date of Patent: May 21, 2002

(54) METHOD FOR MAKING DRIVE SOCKETS

(75) Inventor: Jackie L. Hyatt, Lincolnton, NC (US)

(73) Assignee: Hand Tool Design Corporation

( * ) Notice: Subject to any disclaimer, the term of this patent is extended or adjusted under 35 U.S.C. 154(b) by 0 days.

(21) Appl. No.: 09/797,146

(22) Filed: Mar. 1, 2001

Related U.S. Application Data

(62) Division of application No. 09/346,776, filed on Jul. 7, 1999, now Pat. No. 6,240,813.

(51) Int. Cl.[7] ..... B21H 3/02; B23G 9/00

(52) U.S. Cl. ..... 470/8; 470/16; 470/63; 470/205; 72/358

(58) Field of Search ..... 470/8, 16, 26, 470/63, 89, 91, 205; 72/267, 352, 356, 358, 359

(56) References Cited

U.S. PATENT DOCUMENTS

| | | | | |
|---|---|---|---|---|
| 2,027,922 A | | 1/1936 | McNaught | |
| 2,285,462 A | * | 6/1942 | Purtell | 470/63 |
| 2,896,985 A | | 7/1959 | Braatz | |
| 3,073,192 A | | 1/1963 | Beers | |
| 4,061,013 A | * | 12/1977 | Kuc et al. | 72/358 |
| 4,078,415 A | * | 3/1978 | Koch et al. | 72/356 |
| 4,291,568 A | | 9/1981 | Stifano | |
| 4,328,720 A | | 5/1982 | Shiel | |
| 4,559,803 A | * | 12/1985 | Langford et al. | 72/359 |
| 4,594,874 A | | 6/1986 | Bononi et al. | |
| 4,706,487 A | * | 11/1987 | Bandou et al. | 72/358 |
| 4,993,289 A | | 2/1991 | Parks | |
| 5,101,695 A | | 4/1992 | Johnson | |
| 5,765,430 A | * | 6/1998 | Iihara et al. | 72/358 |
| 5,910,197 A | | 6/1999 | Chaconas | |

FOREIGN PATENT DOCUMENTS

WO PCT/US00/16303 10/2000

OTHER PUBLICATIONS

Dec. 19, 1995—Driving and Spindle Ends for Portable Hand, Impact, Air and Electric Tools.
ASME B107.4M–1995 (cover page, inside cover page and pp. 8 and 9).

* cited by examiner

*Primary Examiner*—Ed Tolan
(74) *Attorney, Agent, or Firm*—R. William Reinsmith; Murtha Cullina LLP

(57) ABSTRACT

A method of making a recess in a drive socket and the like includes forming a groove to extend along a face of an elongated drive opening in a metal workpiece from one end of its drive opening, moving material from the surface of the groove to increase its depth from its outer end along only a portion of its length and gathering the material so moved from the groove surface to form a ledge between ends of the groove, whereby a recess is defined by the groove extending beyond the ledge. In addition, a female drive device for socket wrenches and the like is disclosed having an elongated drive opening, a groove longitudinally extending from one end of the drive opening along a face of the drive opening, and a ledge between ends of the groove. The ledge protrudes radially inwardly such that a recess is defined by the groove extending beyond the ledge for retaining a male drive member.

14 Claims, 20 Drawing Sheets

METHOD FOR MAKING DRIVE SOCKETS

This application is a division of Ser. No. 09/346,776, filed Jul. 7, 1999, now U.S. Pat. No. 6,240,813.

FIELD OF THE INVENTION

This invention generally relates to drive sockets and drive socket forming processes and particularly concerns female drives having retention recesses for hand, power and impact wrenches and the like and an improved method of forming such drives.

BACKGROUND OF THE INVENTION

Various processes have been used in the past in forming socket wrenches, extension bars, adapters and the like. These devices such as the socket wrench itself are standard devices, well known in the art. A conventional square drive socket is provided at one end of the socket wrench and is releasably attachable to a drive tang of a handle unit for a ratchet, for example. A fastener socket is coaxially formed at an opposite end of the wrench. The fastener socket is commonly serrated or of hexagonal crosssection. A through-hole may extend between the coaxially aligned sockets. The through-hole serves to provide clearance, for example, for a shank of a bolt on which a hex nut is threadably engaged with the nut received within the hex fastener socket. For a quality product, such socket wrenches are formed of alloy steel. Standard screw machines conventionally have been used in the manufacture of such wrenches which normally require several sequential machining operations.

Drive socket openings for such wrenches commonly have a recess for receiving a spring-operated ball, for example, in a tang of a drive handle for retaining the socket wrench and handle attachment in driving engagement. However, problems are frequently encountered in forming such recesses in socket wrenches and the like because of long standing difficulties in achieving consistency and accuracy in the size, shape and location of a recess in a face of the drive socket opening while also insuring that the depth of the recess is consistently accurate, particularly when each face of the drive opening has a recess. Specifications for female ends of such square drives for hand, power and impact wrenches are set forth in Table 7, The American Society of Mechanical Engineers publication ASME B107.4M-1995.

When such parts are being produced by machining operations such as turning or index milling operations, for example, how one sets a cutter and how one sets the travel of the cutter are variable but important functions. If the drive opening is not precisely dead center relative to a major longitudinal axis of the workpiece or if the cutting tool itself is somewhat off center, any resulting product will be non-conforming because the recesses are of different depth, or the recesses are misaligned from a symmetrical centered position in the faces of their respective drive opening, or the recesses are not axially aligned relative to the major longitudinal axis of the part. Moreover, such machining processes require specialized equipment, are expensive if not fully automated, suffer from limited tool life and resultant defects such as burrs.

OBJECTS OF THE INVENTION

One object of this invention is to provide an improved drive socket having a unique recess of predetermined depth in a face of a drive socket opening with the recess precisely located in desired symmetrical relation to a face of the drive socket opening. Included in this object is the aim of providing an improved method of making such a drive socket.

Another object is to provide an improved drive socket having a plurality of drive faces within a drive opening wherein every face has a recess formed at an identical depth and location relative to the recesses in the other faces and a method of making such a drive socket.

Still another object is to provide an improved method of making a recess in a face of a drive opening of a drive socket of high quality in a simplified manufacturing process of reduced cost and which eliminates commonly required secondary machining operations.

Other objects will be in part obvious and in part pointed out more in detail hereinafter.

SUMMARY OF TH INVENTION

This invention is directed to a method of making a drive socket with a recess in its drive opening for use in retaining the drive socket on a complementary handle attachment and includes a series of steps. A metal workpiece is first provided having a drive opening with a face extending inwardly from one end of the drive opening. A metal forming step forms a groove along at least a portion of the length of the face of the drive opening, followed by moving material from the groove surface along only a portion of the length of the groove and gathering the moved material to form a ledge between ends of the groove such that a recess is defined by the groove extending beyond the ledge.

This invention also is directed to a drive device having a metal socket with a drive opening having a face extending inwardly from adjacent one end of the drive opening. A groove extends along at least a portion of the face of the opening. A ledge protrudes radially inwardly from the groove between ends of the groove such that a recess is defined by that portion of the groove extending beyond the ledge.

A better understanding of the objects, advantages, features, properties and relations of the invention will be obtained from the following detailed description and accompanying drawings which set forth certain illustrative embodiments and are indicative of the various ways in which the principles of the invention are employed.

DESCRIPTION OF THE PREFERRED EMBODIMENTS

Referring to the representations of prior art illustrated in FIGS. 1–8, drive ends and spindle ends for portable hand, power, impact, air and electric tools are depicted having square female ends. As is well known in the art, a retention feature is commonly provided in the drive end, say, of a socket wrench in the form of a recess for receiving a spring-operated ball, for example, in a drive tang of a handle attachment such as that of a ratchet for positioning and holding the socket wrench in relation to the tang of the handle so that the device can be released by force applied to one of the parts.

A cross-hole type retention feature is shown in devices 2, 4 and 6 of FIGS. 1–3 and FIG. 5 providing a recess in a drive opening 10, 12 and 14, respectively, wherein the recess is formed in a face 10A, 12A and 1 4A of the opening by cross holes 16, 18 and 20. These holes are usually drilled, but in some cases, can be pierced. In the design shown in FIG. 1, it is up to the user to orient the device 2 to a ball (not shown) on the attachment, such as a ratchet handle. It may be made more user friendly by having a hole in each of the four flats of the opening, but this adds more costs.

Figure 1:
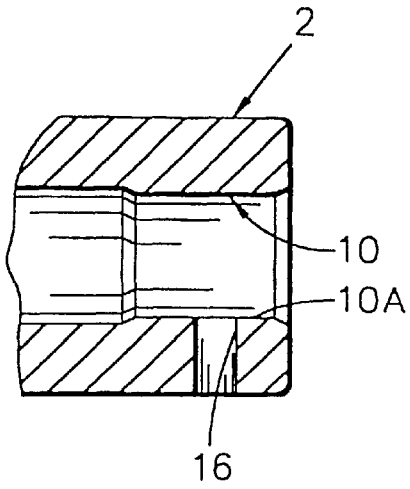
FIG. 1 (PRIOR ART)
FIG. 1 is a cross-sectional view, partly broken away, showing a female drive end of a prior art square drive device.
Figure 2:
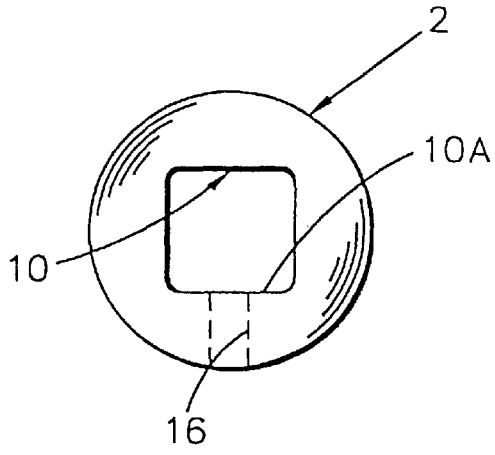
FIG. 2 (PRIOR ART)
FIG. 2 is an end view of the device of FIG. 1.
Figure 3:
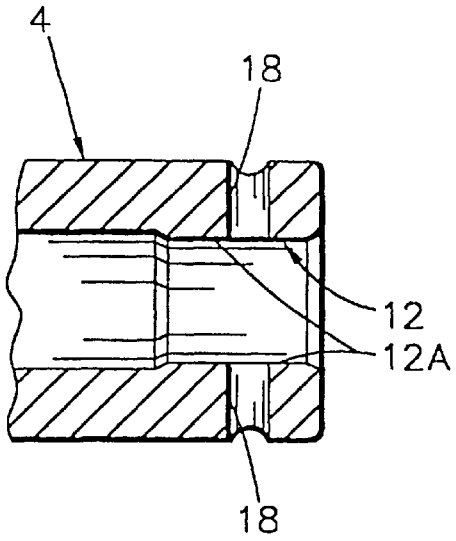
FIG. 3 (PRIOR ART)
FIGS. 3–8 are cross-sectional views, partly broken away, showing other embodiments of female drive ends of prior art square drive devices.
Figure 4:
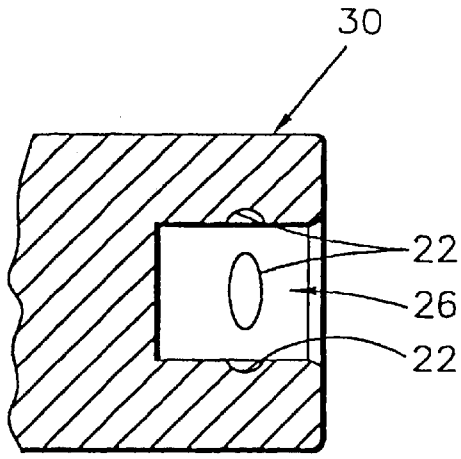
FIG. 4 (PRIOR ART)
Figure 5:
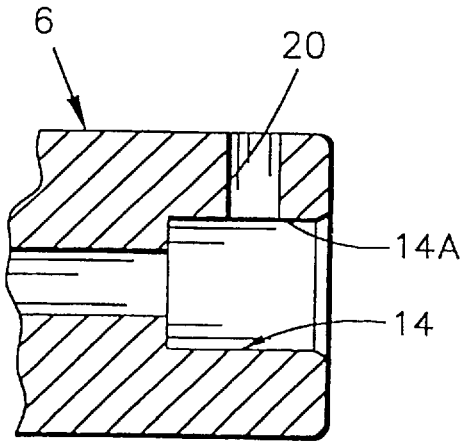
FIG. 5 (PRIOR ART)
Figure 8:
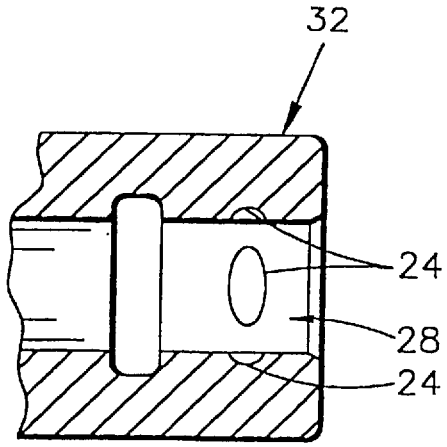
FIG. 8 (PRIOR ART)

FIGS. 4 and 8 show a design wherein recesses such as at 22 (FIG. 4) and 24 (FIG. 8) will be understood to be formed on each of the four faces of a square opening 26 and 28 to provide the retention feature. The drive device 30 (FIG. 4) and 32 (FIG. 8) may be a socket wrench, e.g., that is clamped on its outside diameter and is then machined or cut by spinning the socket and inserting a cutting tool or burr bit (not shown) into its square opening 26, 28. Manufacturing by such machining is slow and expensive because it is critical to meet dimensional criteria.

Figure 6:
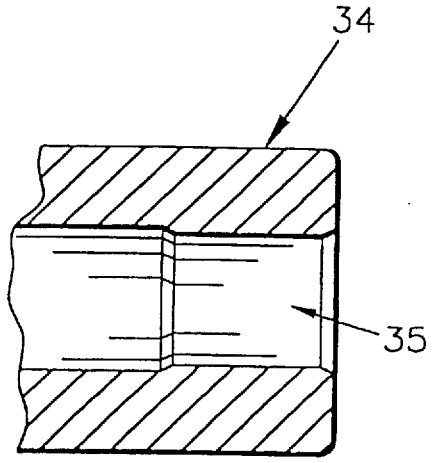
FIG. 6 (PRIOR ART)

The device 34 shown in FIG. 6 does not have any retention feature within its square opening 35 nor is it required for one quarter inch female openings in accordance with the standards prescribed in ASME B107.4M1995.

Figure 7:
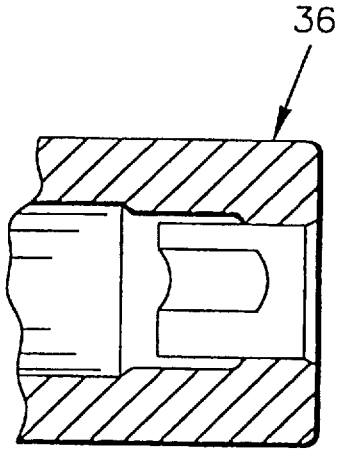
FIG. 7 (PRIOR ART)

The prior art device 36 of FIG. 7 is also formed in a series of machining operations, and this retention design is limited to sizes that are large enough to pass a drill or reamer through an end opposite the square drive end of the tool, i.e., through the end on the left hand side of the device 36 as viewed in the drawing.

It will be appreciated by those skilled in the art that if the square drive opening is not precisely formed to extend longitudinally within the workpiece in coaxial alignment with a major longitudinal axis of that workpiece, the depth of the recesses 22 and 24 shown, for example, in FIGS. 4 and 8 will be different. If the axes of the drive end opening and the workpiece are not contained in the same plane, those same recesses will be misaligned axially along the length of the device just as the cross holes 18 (FIG. 3) would be if they were not coaxially formed in perpendicular relation to the major axis of the device 4. In each of the prior art devices illustrated in FIGS. 1–5, 7 and 8, the forming of the square drive opening and the ball receiving recess are separate independent steps subject to critical dimensional tolerances, whether by punching or broaching the drive square, or by piercing, cross-hole drilling, or by turning or milling operations in forming the recesses. Any error in aligning and/or centering of the workpiece or the machine tool results in recesses of undesired different depth, undesired misaligned recesses or recesses that are not symmetrically located on the drive face of the square drive opening.

Figure 9:
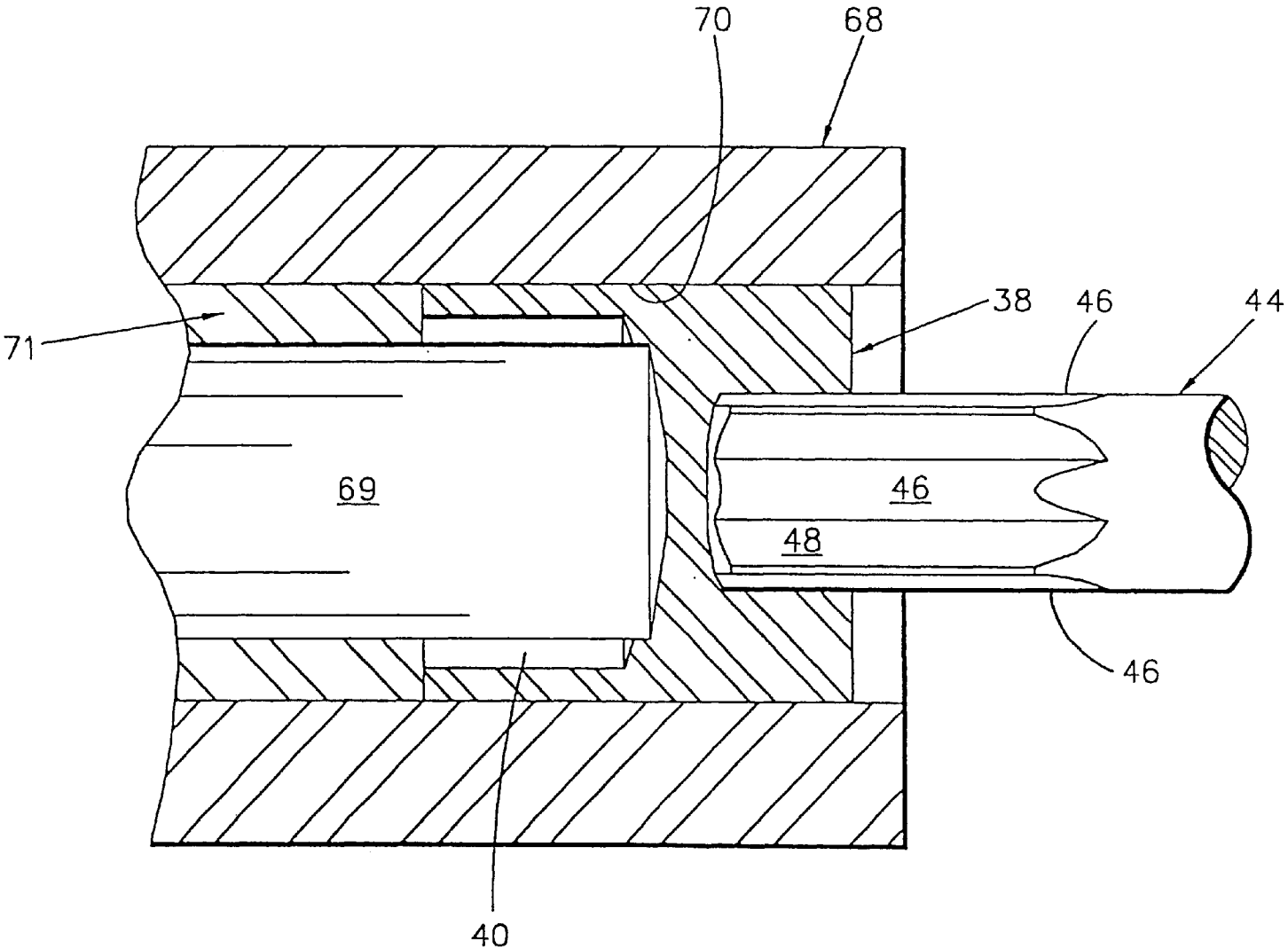
FIGS. 9 and 10 are schematic representations showing one embodiment of a method of this invention.
Figure 9B:
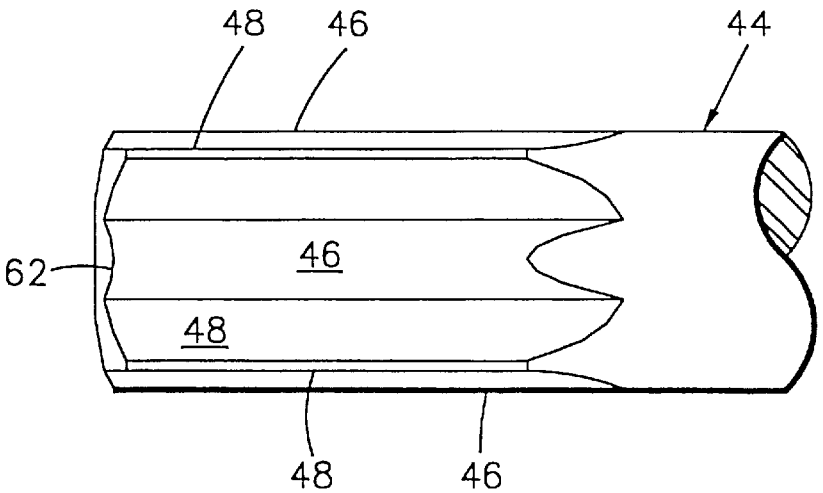
FIGS. 9B and 10B are side views, partly broken away, of a punch used in the steps shown in FIGS. 9 and 10, respectively.
Figure 9A:
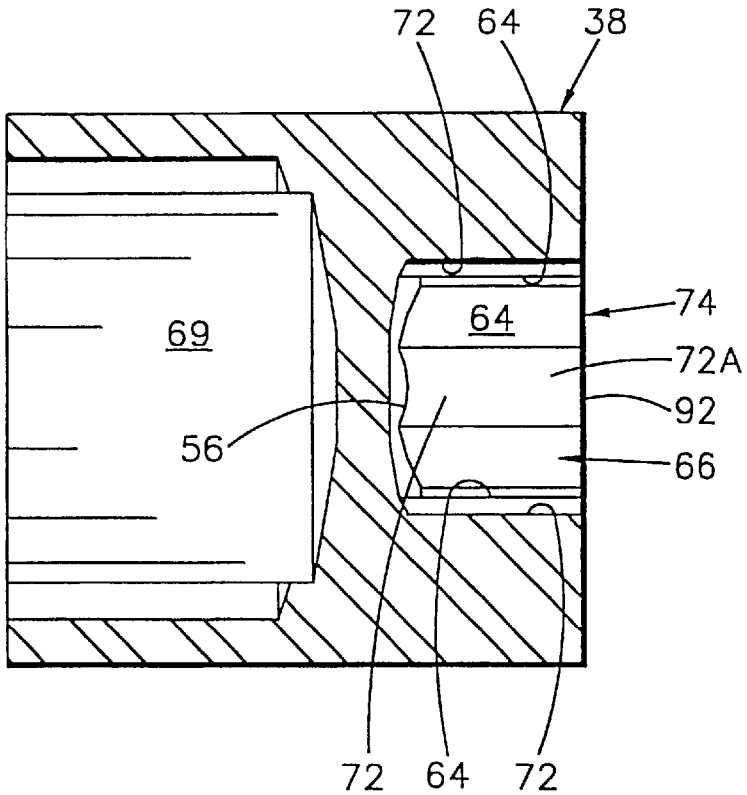
FIGS. 9A and 10A are cross-sectional views of a workpiece corresponding to the steps illustrated in FIGS. 9 and 10, respectively.
Figure 10:
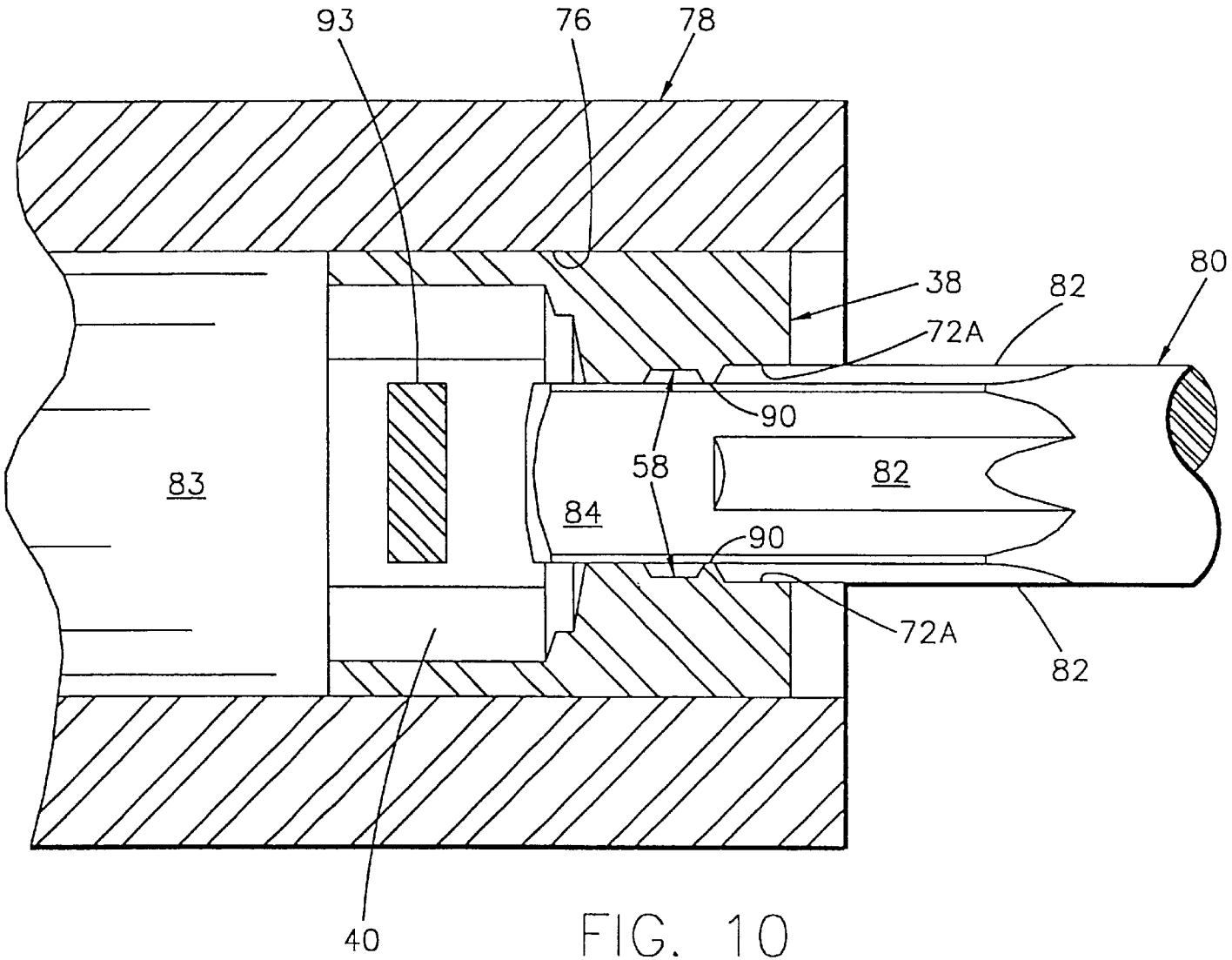
Figure 10B:
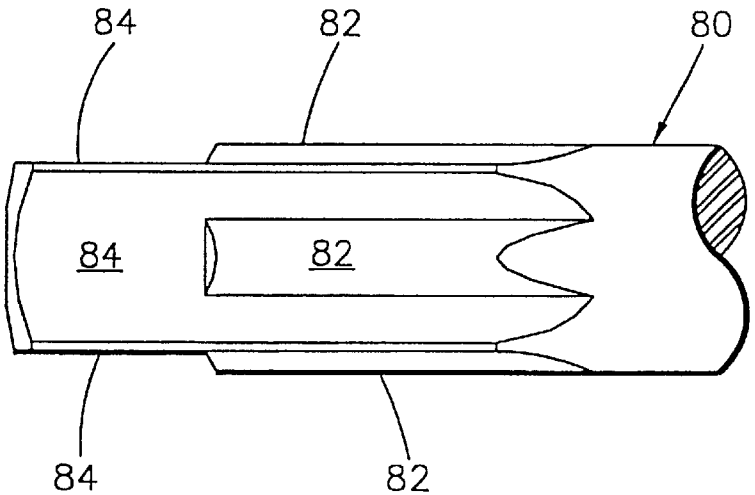
Figure 10A:
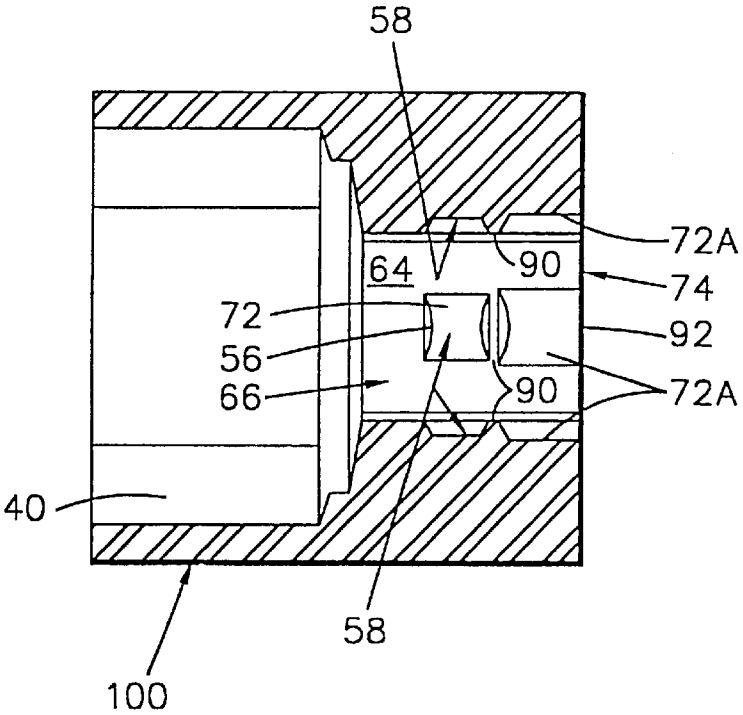

Referring now in detail to steps of the present invention shown in FIGS. 9 and 10 and corresponding FIGS. 9A, 10A and FIGS. 9B, 10B, it will be understood that a finished quality product is formed from metal which can be of different compositions including carbon steels and steel alloys to provide quality female drive ends for a wide variety of tools including hand tools, power tools, impact tools such as socket wrenches, extension bars, adapters and the like. For convenience, the finished product is hereinafter called a drive socket. In the specifically illustrated embodiment of FIGS. 9 and 10, a workpiece 38 is shown having a fastener socket 40 of hexagonal cross-section for use in driving a correspondingly shaped fastener (not shown).

To provide workpiece 3 8 with a retention feature, a recess of a precisely controlled, predetermined depth is desired to be formed in an economical manner suited to be readily repeated and to provide consistently uniform part dimensions particularly adapted for an automated metal forming operation.

An extrusion punch 44 (FIGS. 9, 9B) preferably is provided that has a square cross-section corresponding to a desired size of a square drive opening, for example, of the drive socket to be formed from workpiece 38. Punch 44 has a raised protuberance or hump 46 extending longitudinally along each flat (such as shown at 48) of the square punch 44 with each hump 46 located precisely midway between opposite longitudinal edges of its respective flat 48. The limit of travel of the leading end 62 of each hump 46 of the extrusion punch 44 within workpiece 38 establishes a desired location of an inner groove end such as at 56 for a recess 58 (FIG. 10A) to be formed within workpiece 38.

Although a drive socket may be formed, say, with only one recess 58 in its drive end, in this specifically illustrated embodiment, it is intended that a recess 58 be formed in each face such as at 64 of the square drive opening 66, and extrusion punch 44 (FIGS. 9, 9B) is provided accordingly with a series of identical humps 46 symmetrically located respectively on each of the four flats such as at 48 of the square punch 44. As will be seen, there then will be no need for an end user to orient the drive opening 66 to a ball in a drive attachment. While there are a number of different ways to make a recess in a drive socket, a multi-station forming process is described below in reference to FIGS. 9 and 10.

Once workpiece 38 is transferred by suitable transfer fingers, not shown, in a well known manner to carry the metal workpiece into longitudinally aligned position with die station 68 (FIG. 9) which has a die cavity 70 of a volume substantially equal to that of the workpiece 38, a ram, not shown, preferably moves punch 44 to force workpiece 38 into cavity 70 against stop pin 69 (FIG. 9). Punch 44 forms square drive opening 66 in workpiece 38 with a precisely centered groove 72 (FIG. 9A) extending longitudinally from outer drive end 74 of each face 64 of the drive opening 66 by exerting sufficient pressure on workpiece 38 to cause flow of metal between the die 68 and the external surface of the square punch 44 centrally located within die cavity 70 (FIG. 9). Upon retraction of the square punch 44 (FIGS. 9A, 9B), the workpiece 38 is ejected from die 68 by knock-out sleeve 71 and moved into aligned registration with a cavity 76 of a second die station 78 (FIG. 10) by suitable transfer fingers, not shown.

Figure 11:
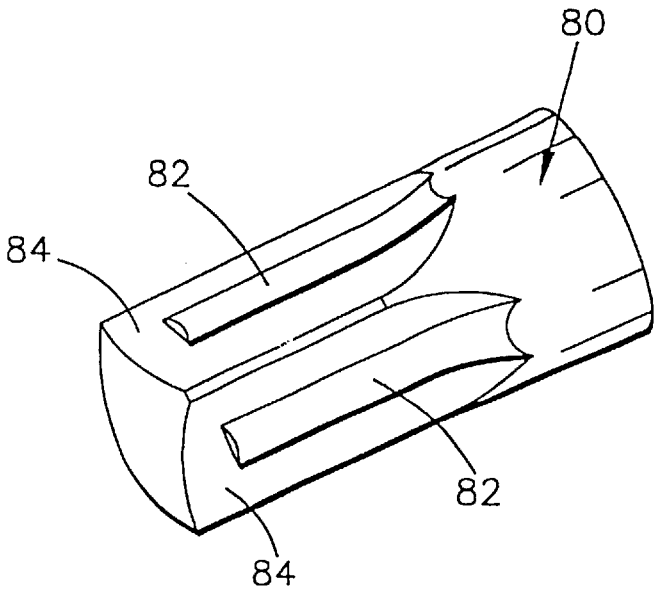
FIG. 11 is an isometric view, partly broken away, of a punch of the type shown in FIG. 10B.

In accordance with this invention, a second punch, namely, a square finishing punch 80 (FIGS. 10, 10B and 11) is provided with humps, such as at 82, symmetrically located on each flat 84 of the square punch 80 and of increased height relative to humps 46 of extrusion punch 44 (FIG. 9B). At this second die station 78, partially formed workpiece 38 is inserted into cavity 76 under the force of ram operated square punch 80 that is aligned with square opening 66 and drives into the cavity 76 to seat workpiece 38 against a lock-out pin 83. Humps 82 increase the depth of the grooves at their lead-in portions 72A in accordance with this invention. That is, humps 82 move metal material from a surface or face of each previously formed groove 72 to increase its depth at a lead-in portion 72A along only that portion 72A of each groove 72 and gather the material so moved from the face of groove portion 72A to form a ledge 90 intermediate opposite inner and outer ends 56 and 92 of groove 72. By virtue of this method, a recess 58 is accordingly defined in each face 64 of opening 66 by that portion of groove 72 that extends beyond ledge 90. As seen in FIG. 10, a square slug 93 is pierced out by punch 80 between socket 40 and opening 66. Upon retraction of square finishing punch 80, a finished drive socket 100 (FIG. 10A) is then ejected by knock-out pin 83. Drive socket 100 now has a completely formed drive end with recesses 58 in each face 64 of drive opening 66 of square cross-section.

Figure 12:
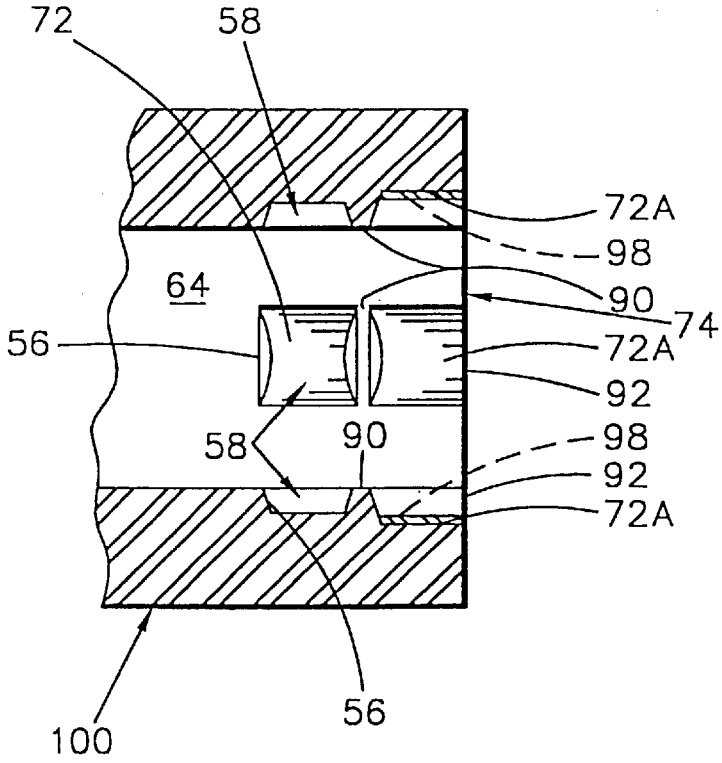
FIG. 12 is a cross-sectional view, partly broken away, showing a drive socket of this invention similar to that shown in FIG. 10A.
Figure 13:
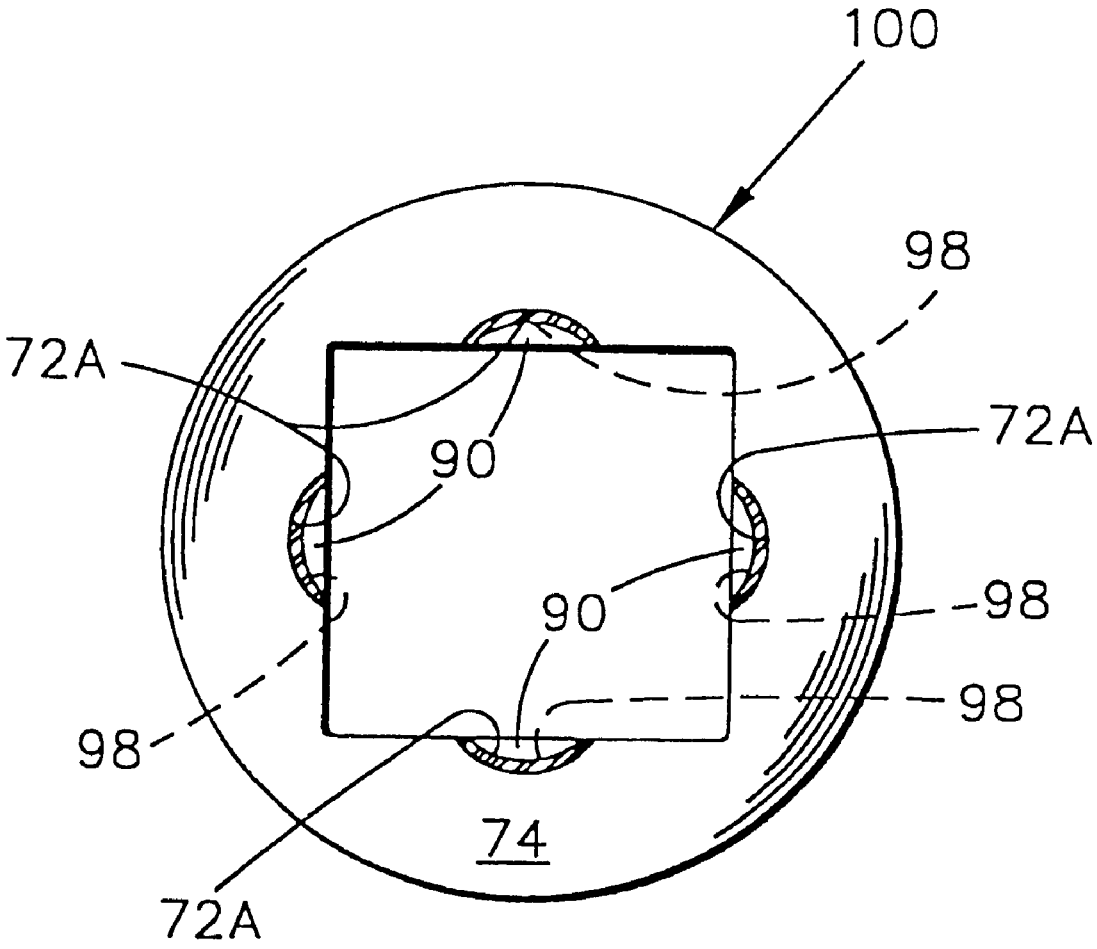
FIG. 13 is an end view of the drive socket of FIG. 12.

In accord with the above described steps, an elongated drive opening 66 of square cross-section and a groove 72 longitudinally extending along at least one face of opening 66 may be preformed in a single operation. While it is contemplated that the drive opening 66 and the groove 72 along at least one of its faces 64 may be formed by other manufacturing operations, the above described use of the disclosed extrusion punch 44 is preferred. Thereafter, in accordance with this invention, the steps of moving material from the face of the previously formed groove to increase its depth along only a portion of its length and gathering the material so moved from the groove portion 72A to form a ledge 90 are performed in a single separate metal forming operation, if desired, simultaneously on each of the four faces 64 of the square opening 66 of workpiece 38. As best seen in FIGS. 12 and 13, the metal material moved from the faces of the lead-in portions 72A of the first formed grooves 72 to increase their depth from the outer ends 92 of the grooves 72 at outer drive end 74 of socket 100 is illustrated in broken lines at 98. The gathered material moved from the lead-in portions 72A of each groove 72 creates the ledges 90 intermediate opposite inner and outer ends 56 and 92 of the grooves 72 to define the recesses 58 of identical size and shape between the inner ends 56 of grooves 72 and the ledges 90.

Figure 14:
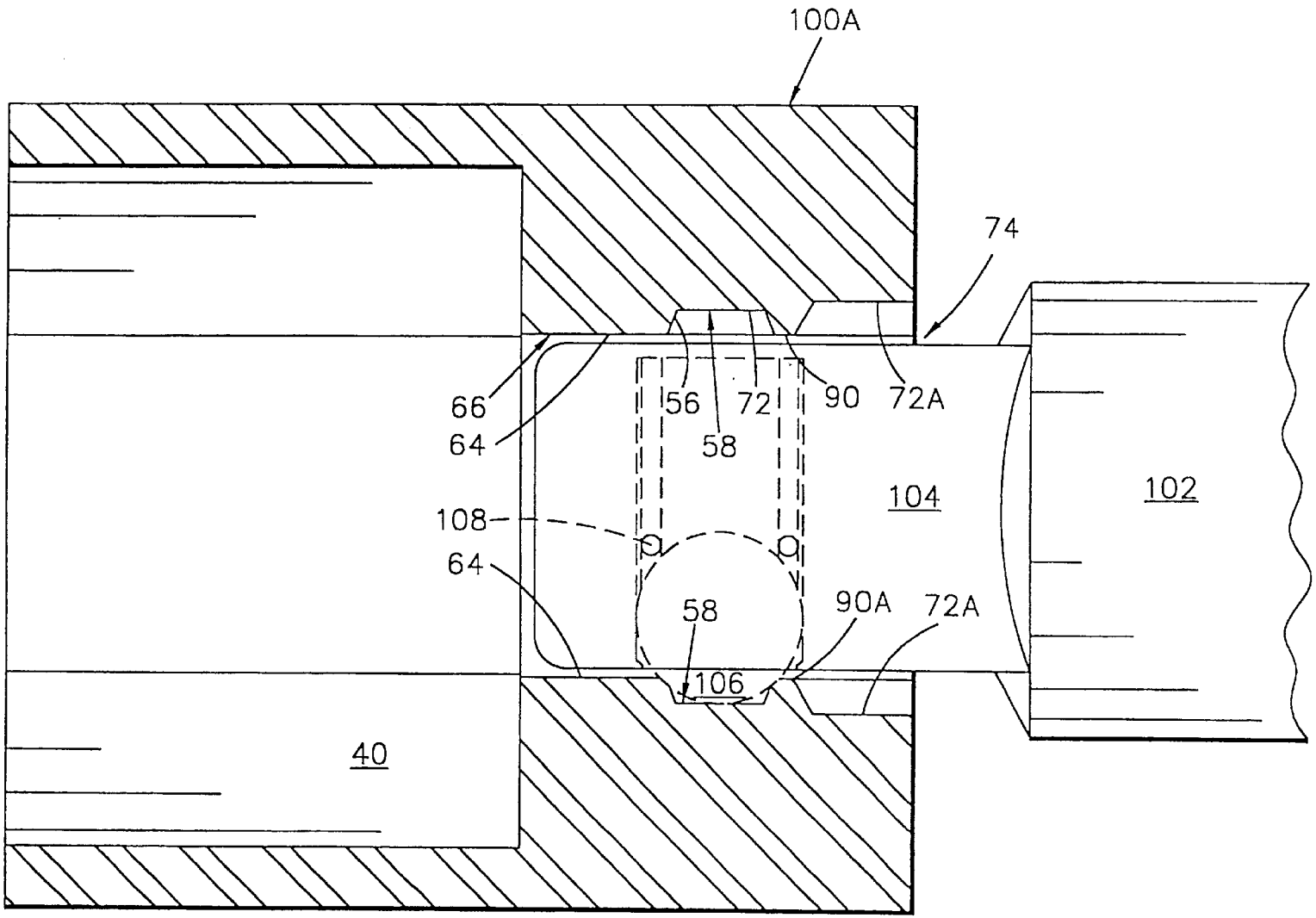
FIG. 14 is an assembly view, partly broken away and partly in cross-section, schematically showing a drive socket of this invention drivingly engaged with a tang of a drive attachment.

A drive socket 100A (similar to drive socket 100 of FIG. 10A) is schematically illustrated in FIG. 14 wherein drive socket 100A is in assembly with a handle unit 102 shown having a drive tang 104 and ball 106, resiliently biased radially outwardly by a spring 108 housed in drive tang 104. Ball 106 is captured within a recess 58 for maintaining the socket wrench 100A and drive handle 102 in driving engagement. Lead-in portions 72A of grooves 72 adjoining the drive socket end 74 of the wrench 100A are of greater depth than the depth of the recesses 58 because of the increased height of the identical humps 82 on finishing punch 80 relative to the height of the identical humps 46 on extrusion punch 44. While the width of the humps 82 of finishing punch 80 are each identical to one another, that width dimension may vary from one finishing punch to another. Thus, a lead-in groove portion 72A of somewhat greater width than the recess 58 may be formed on each face 64 of the opening 66 as in FIG. 10A. Alternatively, that lead-in groove portion 72A may be formed by the finishing punch hump 82 so as to be of equal width to that of the recess 58 as seen in FIG. 12. The height dimension of each hump 82 on finishing punch 80, however, is identical and is always greater than that of the corresponding humps 46 on extrusion punch 44 to ensure proper formation in a given drive socket of identical ledges 90 over which the ball 106 of the handle 102 rides during attachment, before being captured within a recess such as at 58 (FIG. 14). The ball 106 captured within recess 58 significantly reduces any end play due to the bi-directional retention effected by the illustrated assembly.

Figure 15:
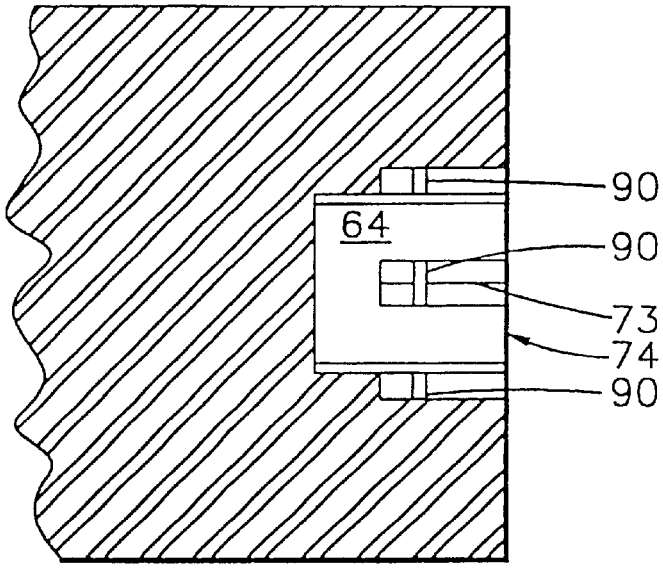
FIG. 15 is a cross-sectional view, partly broken away, showing a portion of another embodiment of a drive socket of this invention.
Figure 16:
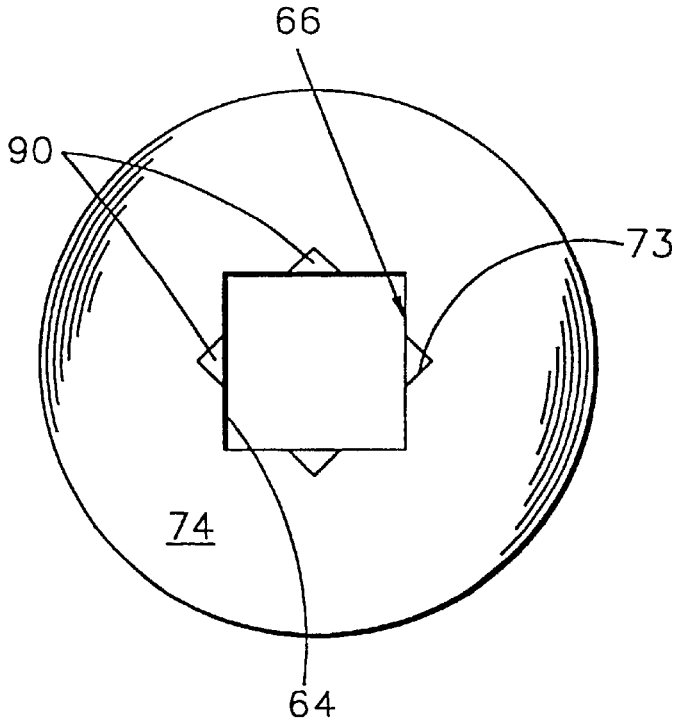
FIG. 16 is an end view of the drive socket of FIG. 15.
Figure 17:
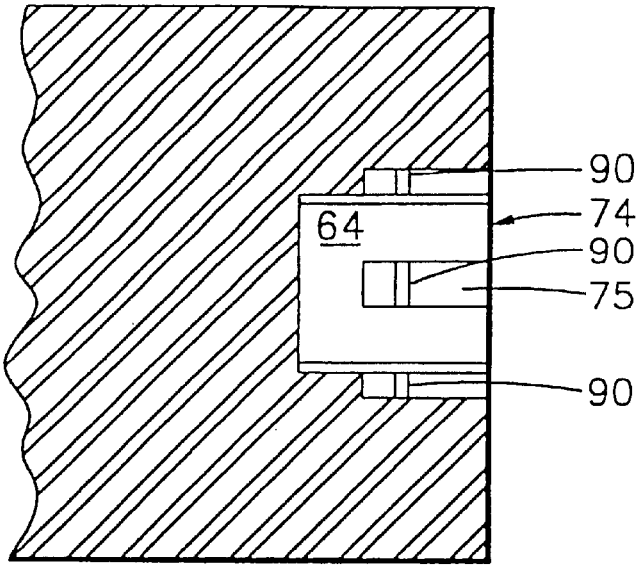
FIG. 17 shows a portion of yet another embodiment of a drive socket, partly broken away and partly in section, of this invention.
Figure 18:
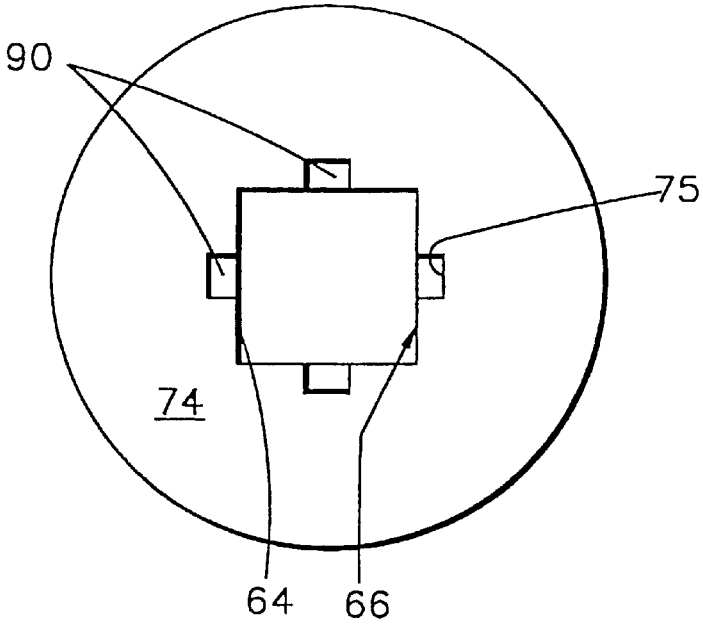
FIG. 18 is an end view of the drive socket of FIG. 17.

The cross-sectional shape of the groove 72 itself is optional. The groove may be of a variety of cross-sectional shapes, and thus the projecting humps on the punches may be of varying cross-section to form grooves of different shapes. For example, the grooves may be of triangular cross-section as shown at 73 (FIGS. 15 and 16) or rectangular cross-section as shown at 75 (FIGS. 17 and 18). The disclosed fluted or arcuate groove such as at 72A (FIG. 13), however, requires less movement of material and is preferred.

Figure 19:
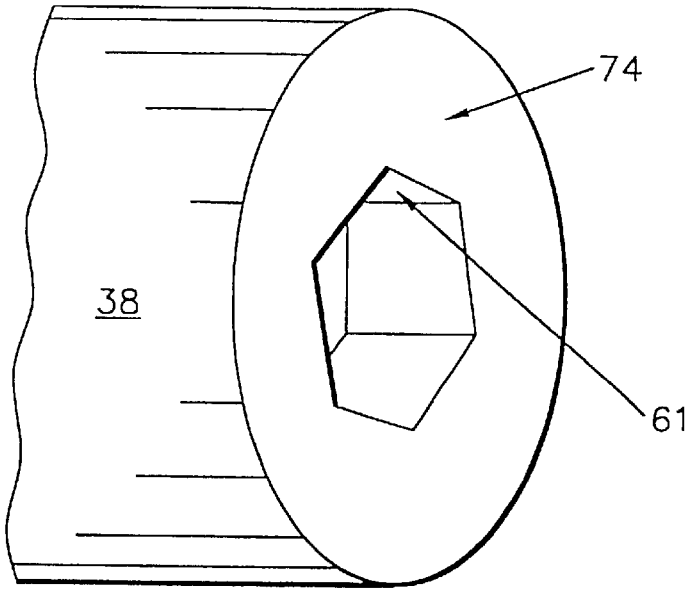
FIGS. 19–22 are isometric views of different types of workpieces suitable to be sequentially formed by a method of this invention to make drive sockets of this invention.
Figure 20:
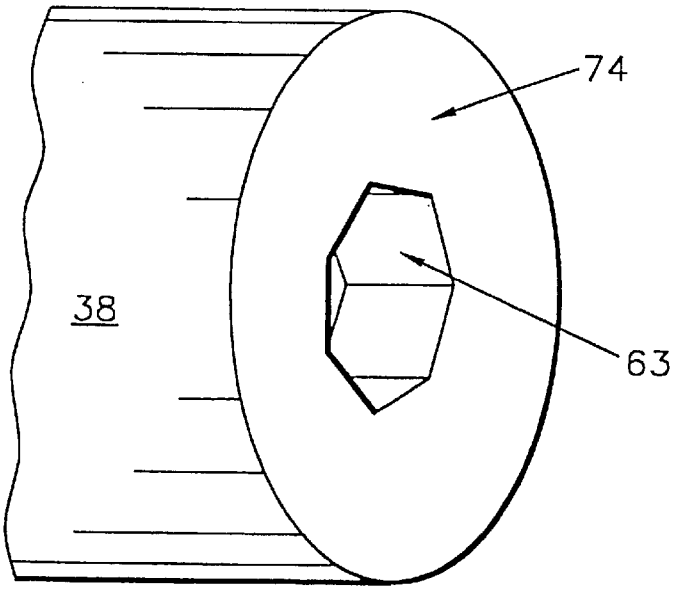
Figure 21:
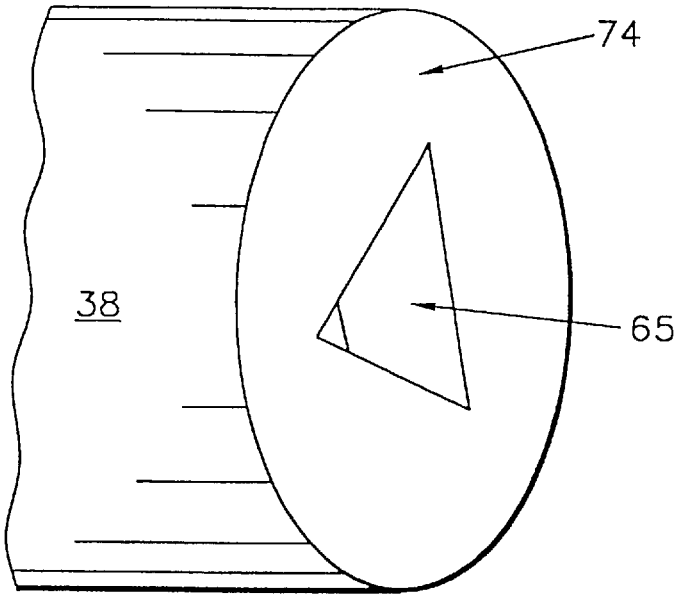
Figure 22:
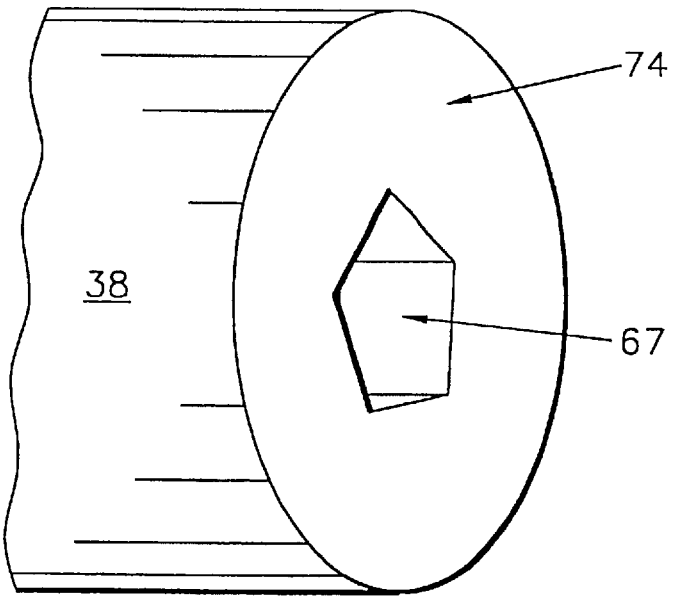
Figure 24B:
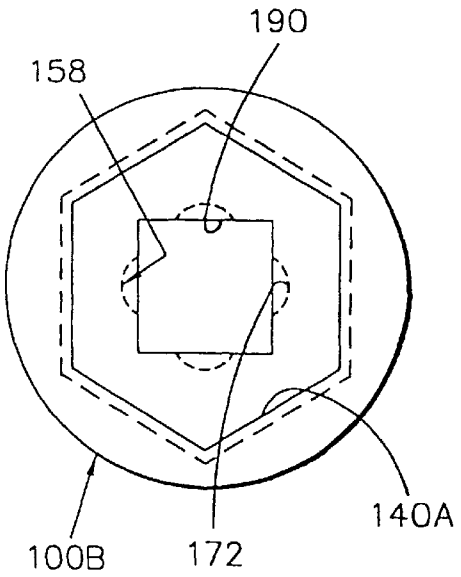
FIGS. 24A and 24B are end views of opposite ends of the drive socket of FIG. 23.

This invention is not limited to a drive socket having a square drive opening such as at 66. Rather, this invention is equally useful with other types of openings within which the above described recesses 58 may be formed such as exemplified by a hexagonal opening 61 (FIG. 19), a seven sided opening 63 (FIG. 20), a triangular opening 65 (FIG. 21) and a pentagonal opening 67 (FIG. 22).

Figure 23:
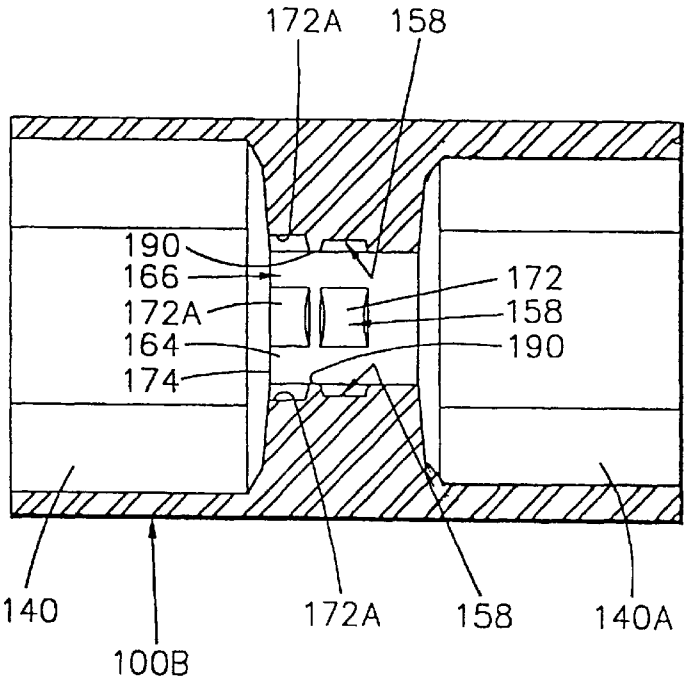
FIG. 23 is a cross-sectional view of another drive socket made in accordance with this invention.
Figure 24A:
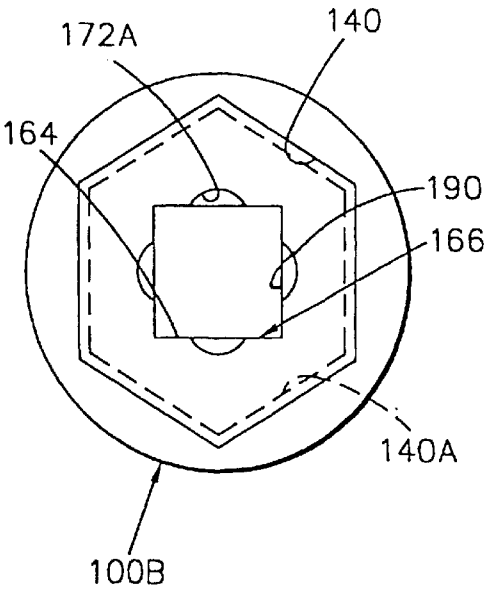

This invention may also be used with a drive opening 166 located between serrated fastener sockets 140, 140A of different sizes on opposite ends of a double ended drive socket 100B (FIG. 23). As in the above described embodiment, at least one face such as at 164 of drive opening 166 is shown formed with a groove 172 extending longitudinally inwardly from outer end 174 of the drive opening 166. It will be understood that a finishing punch, not shown, then moves material from a surface of groove 172 to increase its depth at its lead-in portion 172A and gathers the material so moved to form a ledge such as at 190 which cooperates with groove 172 to form a recess such as at 158. Thus, a central recess is provided for cooperating with a ball on a drive attachment which can be inserted into drive opening 166 from either end. While it is not shown, if it is desired, the groove 172 may be extended the full length of opening 166 with a ledge being formed at each lead-in groove portion at opposite ends of drive opening 166.

Figure 25:
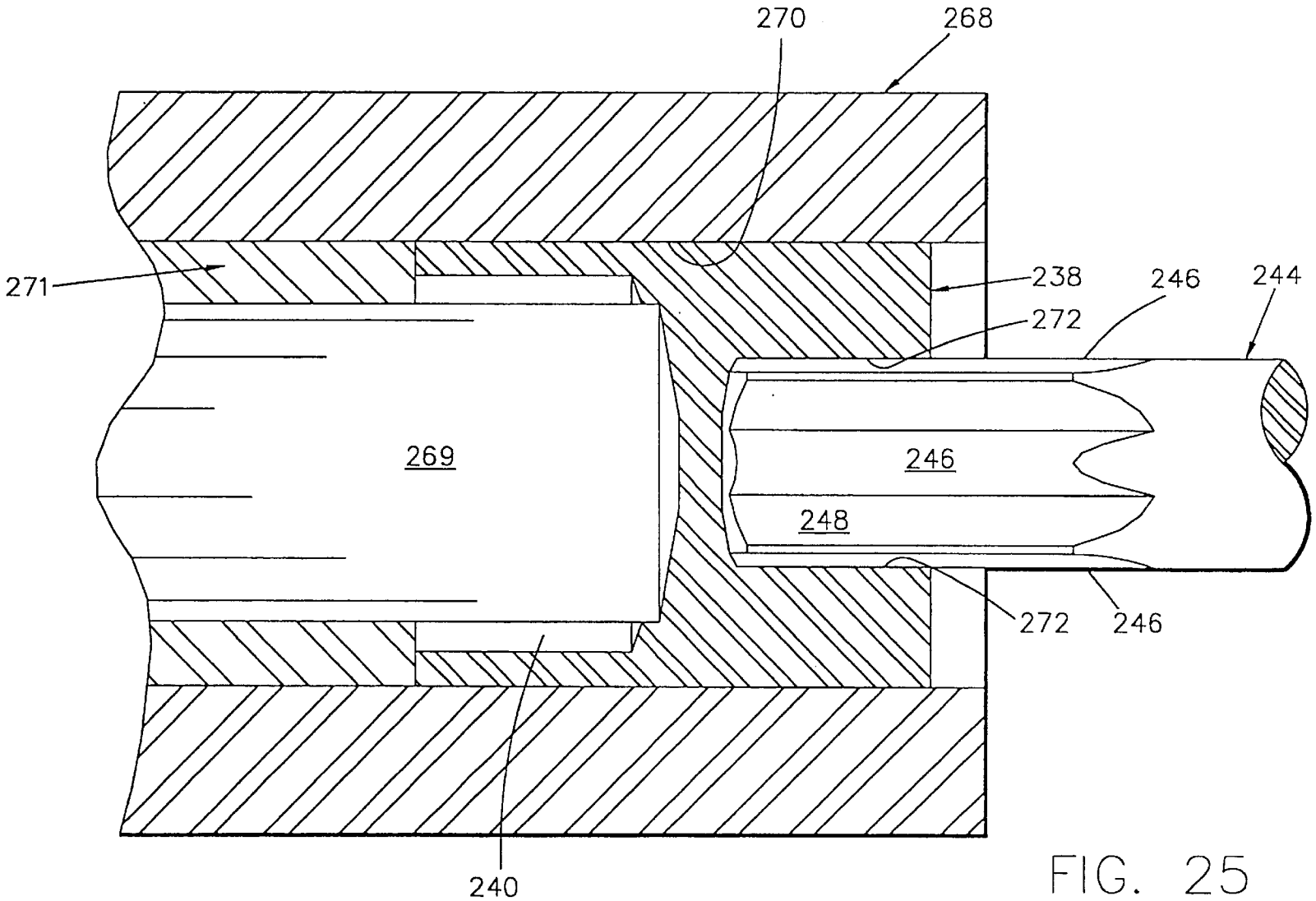
FIGS. 25 and 26 are schematic representations showing a further embodiment of a method of this invention.
Figure 25B:
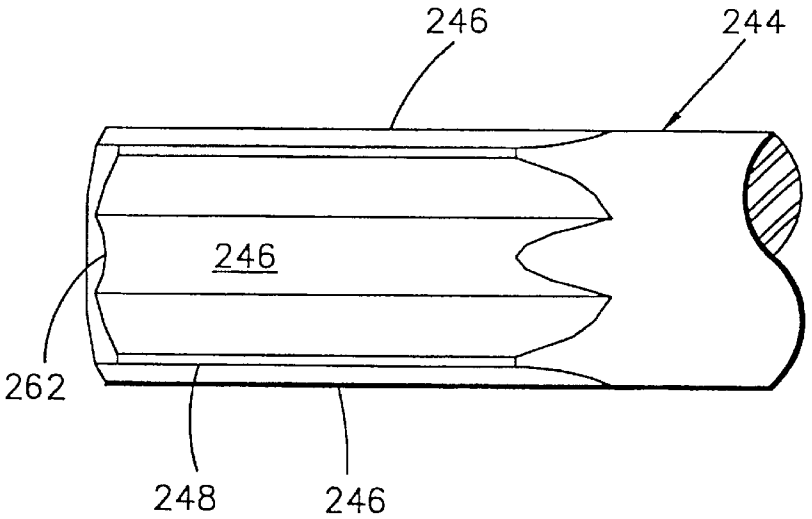
FIGS. 25B and 26B are side views, partly broken away, of a punch used in the steps shown in FIGS. 25 and 26, respectively.
Figure 25A:
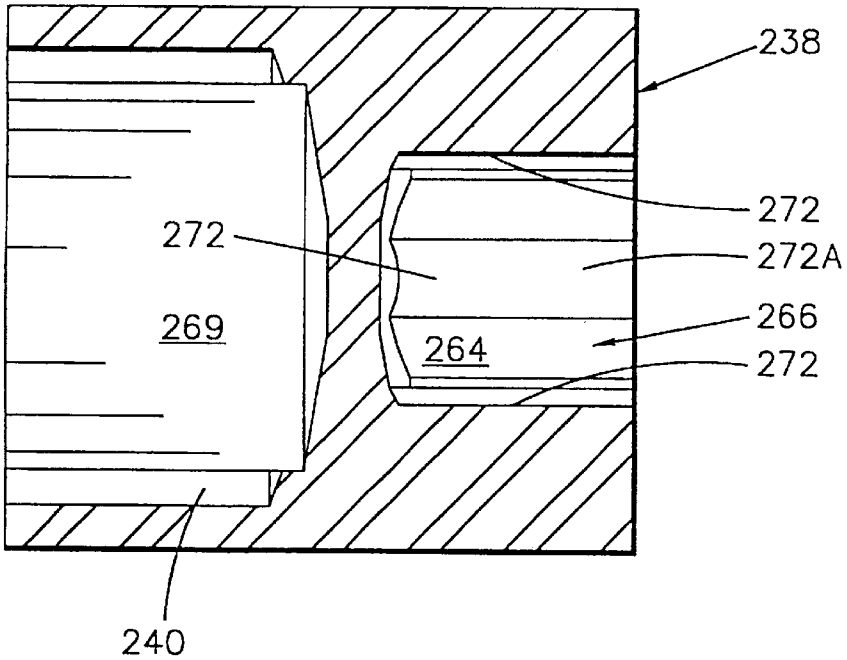
FIGS. 25A and 26A are cross-sectional views of a workpiece corresponding to the steps illustrated in FIGS. 25 and 26, respectively.
Figure 26:
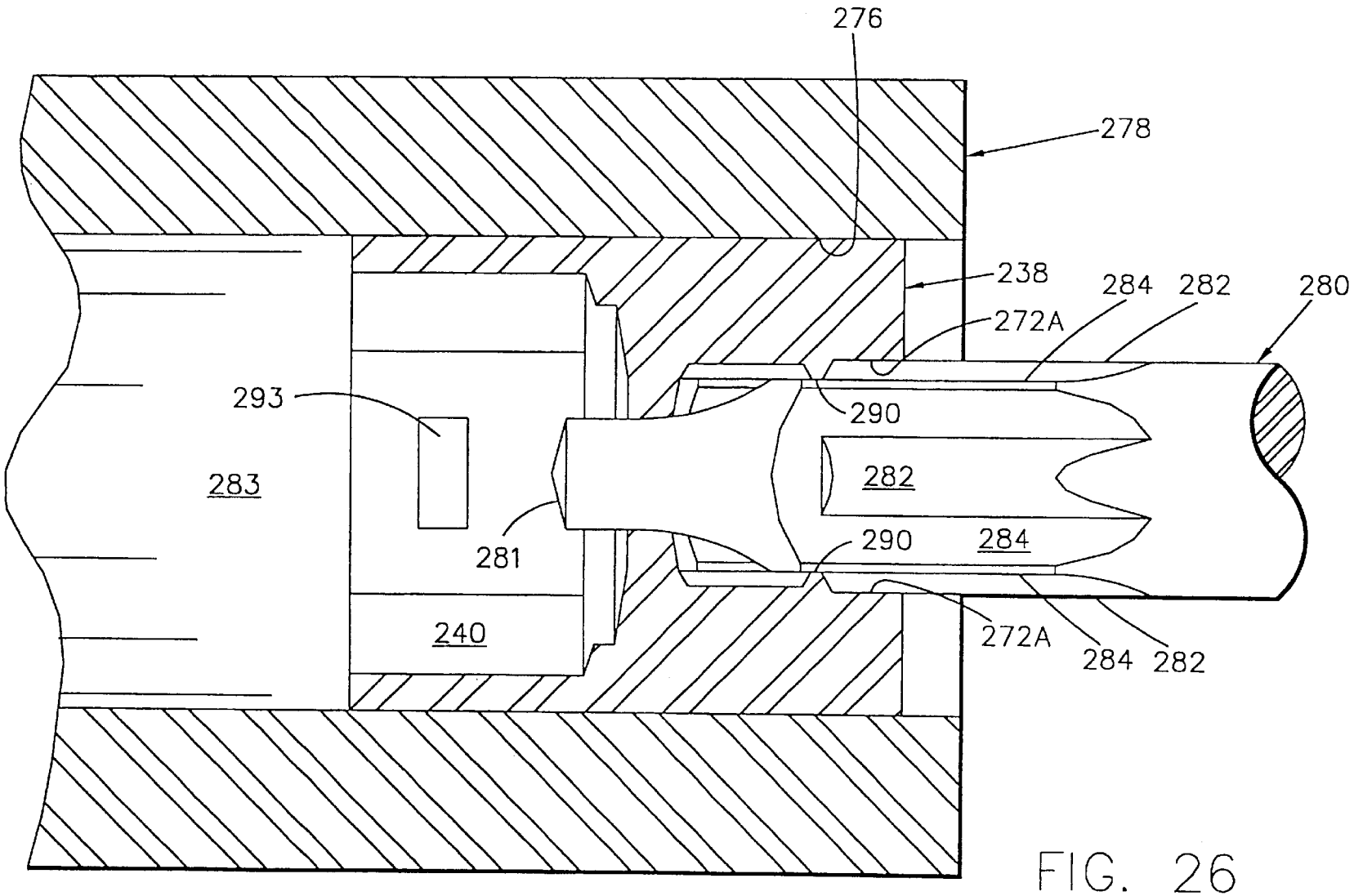
Figure 26B:
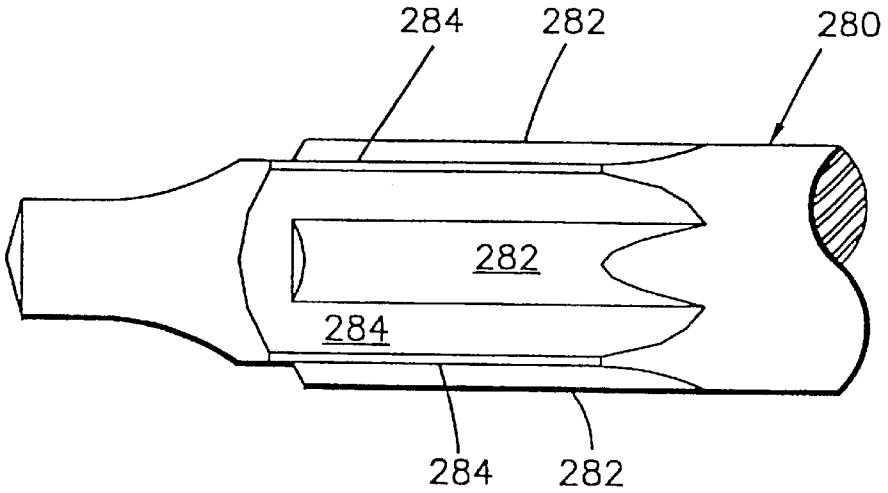
Figure 26A:
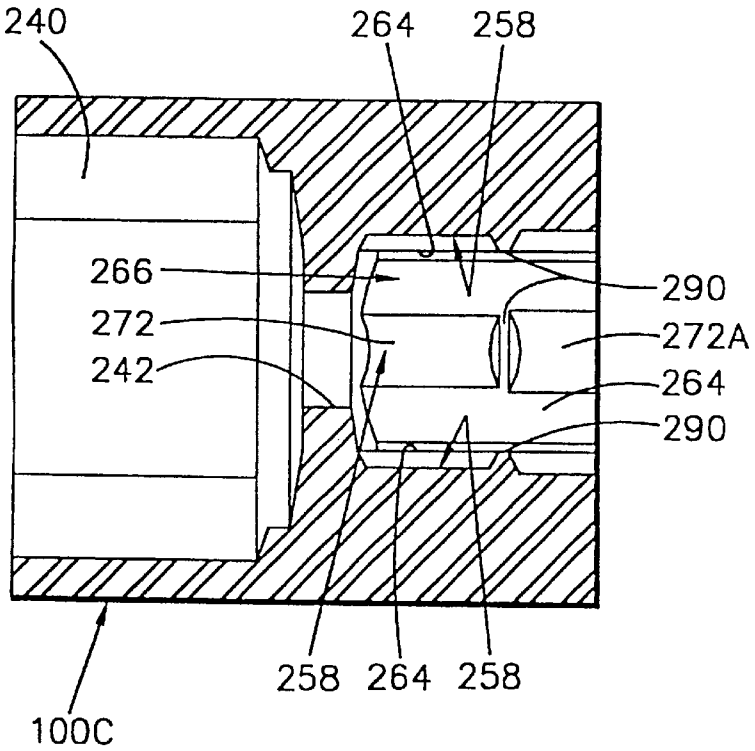

FIGS. 25 and 26 depict steps used in a method (similar to those described above in FIGS. 9 and 10) in forming a recess 258 (FIG. 26A) in groove 272, sequentially formed first by square extrusion punch 244 (FIGS. 25 and 25B) and then by square finishing punch 280 (FIGS. 26 and 26B). Square finishing punch 280 has an identical protrusion such as at 282 on each of its four flats (only three of which are shown) uniformly formed in symmetrical relation to its respective flat 284 and of increased height relative to the height of the four identical protrusions such as at 246 on extrusion punch 244. As shown, the latter extend rearwardly from leading end 262 of extrusion punch 244. Accordingly, upon aligning punch 280 with opening 266, the depth of grooves 272 at their lead-in portions 272A is increased by protrusions 282 as square finishing punch 280 drives workpiece 238 against knock-out pin 283 within die cavity 276 to move material from the faces of the lead-in groove portions 272A, increasing their depth, and then gathering the material so moved to form ledges 290 respectively on the four faces 264 (only three faces being shown in FIG. 26A) of the square drive opening 266 with each of the recesses 258 being precisely uniformly formed with a preselected common depth. In this illustrated embodiment, punch 280 has a reduced leading end 281 of circular cross-section serving to pierce a round slug 293 (FIG. 26) from the center of the workpiece 238 to form an opening 242 between the bottom of the drive opening 266 and fastener socket 240. The drive socket 100C of FIG. 26A shows the first formed groove 272 extending to the bottom of the drive opening 266.

Figure 27A:
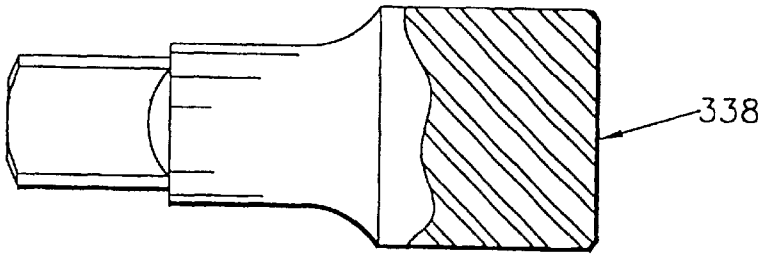
FIGS. 27A, 28A and 29A are side views, partly broken away and partly in section, of a workpiece corresponding to the steps illustrated in FIGS. 27, 28 and 29.
Figure 27:
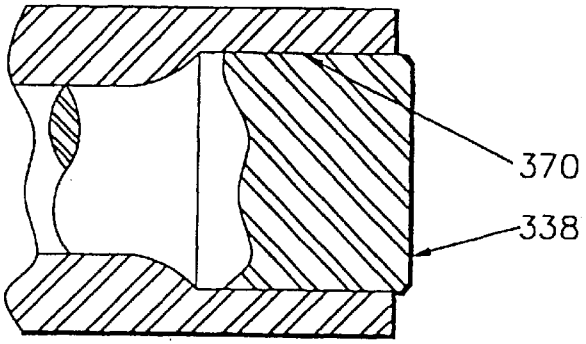
FIGS. 27, 28 and 29 are schematic representations showing yet another embodiment of a method of this invention.
Figure 28B:
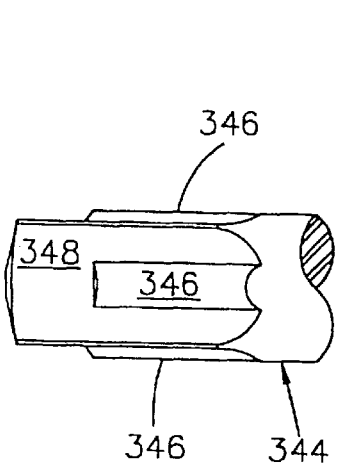
FIGS. 28B and 29B are side views, partly broken away, of punches used in the steps illustrated in FIGS. 28 and 29, respectively.
Figure 28A:
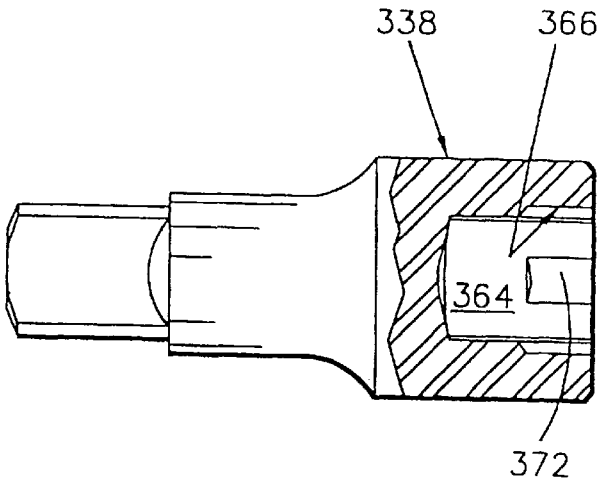
Figure 28:
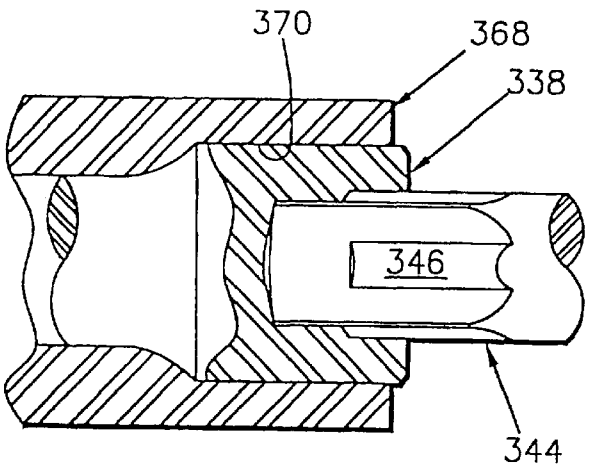
Figure 29B:
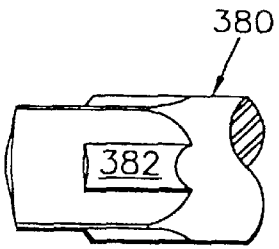
Figure 29A:
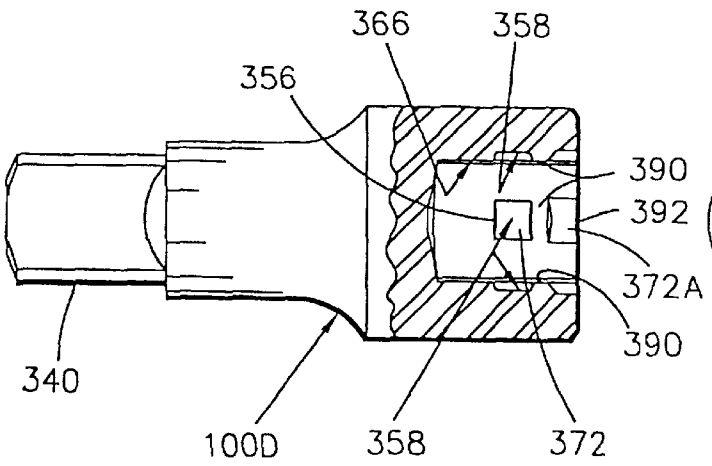
Figure 29:
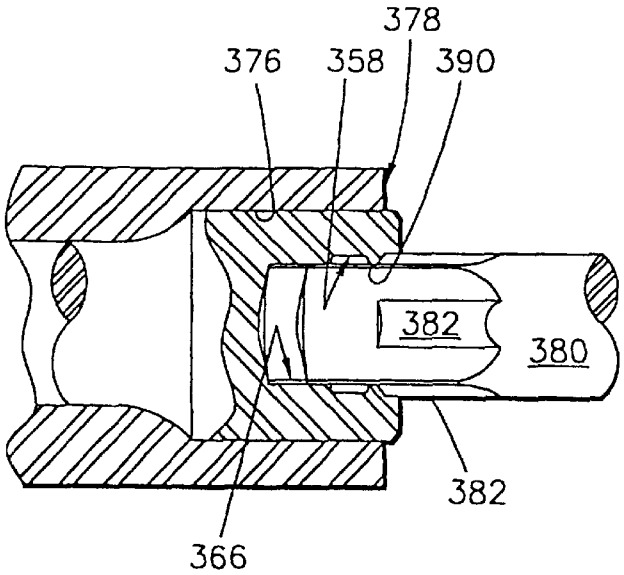

FIGS. 27–29 schematically depict the use of a method of this invention (similar to those described above in FIGS. 9 and 10) that may be used in forming a blind depth socket drive opening 366 with recesses 358 in a reducing adapter (not shown) or extension bar as illustrated at 100D (FIG. 29A). In the method depicted in FIGS. 27–29, it will be understood that workpiece 338 (FIG. 28A) is moved among stations in a multi-station metal forming machine wherein a hump 346 on each flat 348 of square extrusion punch 344 (FIG. 28B) serves to form a groove 372 in precisely centered relation to a longitudinally extending flat 364 of the square opening 366 formed under the driving force of ram operated punch 344 which forms the square opening 366 in workpiece 338 upon flow of metal between die cavity 370 and the external surface of punch 344. Upon retraction of the square extrusion punch 344, workpiece 338 (FIG. 28A) is moved by transfer fingers, not shown, into axial alignment with die station 378. Ram operated finishing punch 380 (FIG. 29B) that is in aligned registration with workpiece 338 (FIG. 28A) drives that partially formed workpiece 338 into die cavity 376 of die 378, whereby the driving force of the ram operated square finishing punch 380 increases the depth of the lead-in portions 372A of grooves 372 and moves the material therefrom and gathers it to form ledges 390 between opposite inner and outer ends 356 and 392 of grooves 372. Accordingly, recesses 358 are defined by grooves 372 extending beyond ledges 390 for retaining a male drive member.

The disclosed invention is suited not only for use in cold forming and so-called warm forming processes but also in hot forming of alloys of higher strength qualities so as to be used with a wide variety of metals including carbon steels and high quality steel alloys. Except for possible removal of crusty scale after cooling a part made by a hot forming process, secondary machining operations commonly encountered in conventional metal forming are eliminated, together with the additional time consuming manufacturing steps and costs inevitably associated with such secondary machining operations. In addition, burrs common to such machining processes are also eliminated. By virtue of the closely controlled dimensioning of each groove and recess formed in accordance with this invention, the grooves and recesses on each face of the drive opening of a given drive socket are identically formed in precisely uniform shapes and sizes for improved fit-up of the drive unit within its drive socket and to provide improved consistency in pull-off forces required because of the identical ball recess depth on all sides of the socket drive opening.

Although this invention has been illustrated and described with respect to exemplary embodiments thereof, it should be understood by those skilled in the art that various changes, omissions and additions may be made without departing from the spirit and scope of the invention.

I claim:

1. A method of making a recess in a drive socket and the like and comprising the steps of providing a metal workpiece having a drive opening with a face extending inwardly from one end of the drive opening, forming a groove having a surface extending from an outer groove end along at least a portion of the face of the opening, moving material from the groove surface to increase the depth of the groove from its outer end along a portion of its length, and gathering the material moved from the groove surface to form a ledge between ends of the groove, whereby a recess is defined by the groove extending beyond the ledge.

2. The method of claim 1 wherein the providing step includes providing a generally cylindrical metal workpiece with the face of the drive opening extending in axially aligned relation to a major longitudinal axis of the workpiece.

3. The method of claim 1 wherein the providing step includes providing a metal workpiece having an elongated drive opening with a flat face, and wherein the forming step includes forming the groove to extend from an outer groove end adjacent the one end of the drive opening in symmetrically aligned relation to the flat face of the opening.

4. The method of claim 1 wherein the forming step includes simultaneously forming both the drive opening of the providing step and the groove of the forming step in a single metal forming operation.

5. The method of claim 1 wherein the steps of moving and gathering are simultaneously performed in a single metal forming operation.

6. The method of claim 5 wherein the moving and gathering steps are effected by providing a punch having a longitudinally extending flat thereon and a protrusion longitudinally extending along the flat of the punch for registration with the groove with the protrusion being of greater height than the depth of the groove, and driving the punch into the workpiece to move material and increase the depth of the groove from its outer end along only a portion of its length and to simultaneously gather the material being moved to form the ledge between ends of the groove.

7. The method of claim 1 wherein the forming step includes forming the drive opening of the providing step with a square cross section having four flat faces longitudinally extending inwardly from adjacent the one end of the drive opening while simultaneously forming a groove symmetrically aligned and longitudinally extending along at least a portion of each of the four faces of the square opening of the workpiece in a single metal forming operation.

8. The method of claim 7 wherein the moving and gathering steps are simultaneously performed in a single metal forming operation on each of the four faces of the square opening of the workpiece to form a ledge in each face in axially aligned relation to the other ledges, whereby recesses of identical size, shape and axial location are formed in each face of the drive opening.

9. The method of claim 1 wherein the forming step is effected by providing a power operated punch of square cross section having four side flats thereon and a groove-forming protrusion longitudinally extending along at least one flat of the punch, driving the workpiece into a cavity of a die with the power operated punch and simultaneously forming the square opening and groove along at least a portion of the length of the face of the opening of the workpiece by flowing its metal material between the punch and die, and wherein the moving and gathering steps are effected by providing a second power operated punch of square cross section having four side flats thereon and a protrusion longitudinally extending along one flat of the second punch corresponding to the protrusion of the first punch with the protrusion of the second punch being of greater height than the protrusion of the first punch, and driving the second punch into the workpiece with the protrusion of the second punch aligned with the previously formed groove in the workpiece to increase the depth of the groove from its outer end along a portion of its length and simultaneously to form the ledge between the ends of the groove.

10. The method of claim 1 wherein the moving and gathering steps are performed in a cold forming process.

11. The method of claim 1 wherein the moving and gathering steps are performed in a hot forming process.

12. The method of claim 1 wherein the moving and gathering steps are performed in a warm forming process.

13. A method of making a recess in a drive socket and the like and comprising the steps of providing a generally cylindrical metal workpiece, forming an elongated drive opening coaxially within the workpiece with a square cross sectional opening and four flat faces extending inwardly from adjacent one end of the drive opening, forming a groove having a surface symmetrically aligned and longitudinally extending along at least a portion of the length of each face of the opening, moving material from the surface of each groove from an outer groove end adjacent the one end of the drive opening to increase the depth of each groove along only a portion of its length, and gathering the material moved from each groove surface to form a ledge between ends of each groove, whereby a recess is defined in each face of the drive opening by its respective groove extending beyond the ledge.

14. The method of claim 13 wherein the first and second forming steps are effected by providing a power operated punch of square cross section having four identically formed side flats thereon with a groove-forming protrusion longitudinally extending in symmetrically aligned relation along each flat of the punch, and driving the workpiece into a cavity of a die with the power operated punch and simultaneously forming the square opening and groove along each face of the opening of the workpiece by flowing its metal material between the punch and die, and wherein the moving and gathering steps are effected by providing a second power operated punch of square cross section having four identically formed side flats thereon with a protrusion longitudinally extending along each flat of the second punch corresponding to that of the first punch with the protrusions of the second punch being identical to one another and of greater height than the protrusions of the first punch, and driving the second punch into the workpiece with the protrusions of the second punch aligned with the grooves in the workpiece to simultaneously perform the moving and gathering steps, whereby the faces of the drive opening have recesses defined by the grooves extending beyond the ledges with the recesses being of identical size and shape and symmetrically located within the drive opening.

* * * * *